US007812799B2

(12) United States Patent
Ko et al.

(10) Patent No.: US 7,812,799 B2
(45) Date of Patent: Oct. 12, 2010

(54) DISPLAY DEVICE WITH IMPROVED GRADATION EXPRESSION AND DRIVING METHOD OF THE SAME

(75) Inventors: Chun-seok Ko, Hwaseong-si (KR); Baek-woon Lee, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 603 days.

(21) Appl. No.: 11/873,310

(22) Filed: Oct. 16, 2007

(65) Prior Publication Data

US 2008/0106538 A1 May 8, 2008

(30) Foreign Application Priority Data

Nov. 8, 2006 (KR) ..... 10-2006-0110206

(51) Int. Cl.
*G09G 3/32* (2006.01)

(52) U.S. Cl. ..... 345/82; 345/690

(58) Field of Classification Search ..... 345/82, 345/83, 76, 77, 89, 95, 204, 211, 690; 315/169.4
See application file for complete search history.

(56) References Cited

U.S. PATENT DOCUMENTS 5,841,410 A * 11/1998 Oda et al. ..... 345/58
7,038,651 B2 * 5/2006 Nitta et al. ..... 345/98
7,321,353 B2 * 1/2008 Tsuda et al. ..... 345/99
2006/0044301 A1 * 3/2006 Ha ..... 345/209
2007/0080905 A1 * 4/2007 Takahara ..... 345/76
2007/0229447 A1 * 10/2007 Takahara et al. ..... 345/102
2007/0291190 A1 * 12/2007 Shin et al. ..... 349/37

* cited by examiner

*Primary Examiner*—Ricardo L Osorio
(74) *Attorney, Agent, or Firm*—Innovation Counsel LLP

(57) ABSTRACT

A display device capable of expressing gradations with improved accuracy is presented. The device includes: a switching thin film transistor (TFT) and a driving TFT on an insulating substrate; a first electrode electrically connected with the driving TFT; a light emitting layer; a second electrode that supplies a common voltage to the light emitting layer; and a data driver that supplies the switching TFT with a data voltage ranging from a first voltage to a second voltage. The first voltage, the second voltage and the common voltage satisfy the equations: 1) First voltage−common voltage−voltage dropped by light emitting layer=black voltage±0.1|black voltage−white voltage|; 2) Second voltage−common voltage−voltage dropped by light emitting layer=white voltage±0.1|black voltage−white voltage|. The black voltage and the white voltage refer to gate-source voltages ($V_{GS}$) that express the lowest gradation and the highest gradation, respectively.

18 Claims, 8 Drawing Sheets

DISPLAY DEVICE WITH IMPROVED GRADATION EXPRESSION AND DRIVING METHOD OF THE SAME

CROSS-REFERENCE TO RELATED APPLICATIONS

This application claims priority from Korean Patent Application No. 2006-0110206 filed on Nov. 8, 2006 in the Korean Intellectual Property Office, the disclosure of which is incorporated herein by reference.

BACKGROUND OF THE INVENTION

1. Field of the Invention

The present invention relates to a display device and a driving method of the same, and more particularly, to a display device which includes poly silicon and a driving method of the same.

2. Description of the Related Art

Recently, flat panel display devices such as a liquid crystal display devices and organic light emitting diodes (OLEDs) have been replacing cathode ray tubes (CRTs) as they become more widely used.

An OLED includes an organic light emitting layer which receives an electron and a hole and emits light. The OLED has been popular since it is driven with a low voltage, is light and small, has a wide viewing angle, and has a fast response speed. Typically, an OLED includes a thin film transistor. The emission intensity of the organic light emitting layer is determined by the number of holes supplied from a pixel electrode that is connected with the thin film transistor.

A semiconductor layer that makes up a part of the thin film transistor may include amorphous silicon or poly silicon crystallized with amorphous silicon. If the thin film transistor includes poly silicon, mobility is excellent and thus a driving circuit may be embedded in a substrate. Also, a large-scale integration is available, and an aperture ratio is improved since the thin film transistor is designed with a smaller size.

The semiconductor layer affects the quality of the thin film transistor, which in turn affects the display quality of the OLED. If a voltage is supplied without consideration of the property of the semiconductor layer, the OLED may not properly express gradations.

SUMMARY OF THE INVENTION

Accordingly, it is an aspect of the present invention to provide a display device which expresses gradations clearly, and a driving method of the same.

Additional aspects and/or advantages of the present invention will be set forth in part in the description which follows and, in part, will be obvious from the description, or may be learned by practice of the present invention.

In one aspect, the present invention is a display device that includes: an insulating substrate; a switching thin film transistor and a driving thin film transistor formed on the insulating substrate, wherein the driving thin film transistor includes a semiconductor layer; a first electrode electrically connected with the driving thin film transistor; a light emitting layer formed on the first electrode; a second electrode which supplies a common voltage at a predetermined level to the light emitting layer; and a data driver which supplies a data voltage to the switching thin film transistor. The data voltage ranges from a first voltage to a second voltage, wherein the first voltage, the second voltage and the common voltage satisfy the following equations:

First voltage−common voltage−voltage dropped by light emitting layer=black voltage±|black voltage−white voltage|*0.1 [Equation 1]

Second voltage−common voltage−voltage dropped by light emitting layer=white voltage±|black voltage−white voltage|*0.1. [Equation 2]

The black voltage refers to a gate-source voltage ($V_{GS}$) that expresses the lowest gradation and the white voltage refers to a gate-source voltage $V_{GS}$ that expresses the highest gradation.

In another aspect, the present invention is a method of driving a display device that includes: providing a display panel having a switching thin film transistor and a driving thin film transistor having a semiconductor layer comprising silicon and fluorine, a first electrode electrically connected with the driving thin film transistor, a light emitting layer formed on the first electrode and a second electrode supplying a common voltage at a predetermined level to the light emitting layer, detecting black and white voltage ranges with respect to a gate-source voltage $V_{GS}$ of the driving thin film transistor, from a drain-source current $I_{DS}$; setting a data voltage range between a first voltage range and a second voltage range, and setting the common voltage supplied to the switching thin film transistor to satisfy the following equations;

First voltage−common voltage−voltage dropped by light emitting layer=black voltage±|black voltage−white voltage|*0.1 [Equation 1]

Second voltage−common voltage−voltage dropped by light emitting layer=white voltage±|black voltage−white voltage|*0.1. [Equation 2]

The black voltage refers to gate-source voltage $V_{GS}$ that expresses the lowest gradation, and the white voltage refers to gate-source voltage $V_{GS}$ that expresses the highest gradation. The set first voltage, second voltage and common voltage are supplied to the display panel.

BRIEF DESCRIPTION OF THE DRAWINGS

The above and/or other aspects of the present invention will become apparent and more readily appreciated from the following description of the embodiments, taken in conjunction with the accompany drawings, in which.

DETAILED DESCRIPTION OF EMBODIMENTS

Hereinafter, embodiments of the present invention will be described with reference to accompanying drawings, wherein like numerals refer to like elements and repetitive descriptions will be avoided as necessary.

Figure 1:
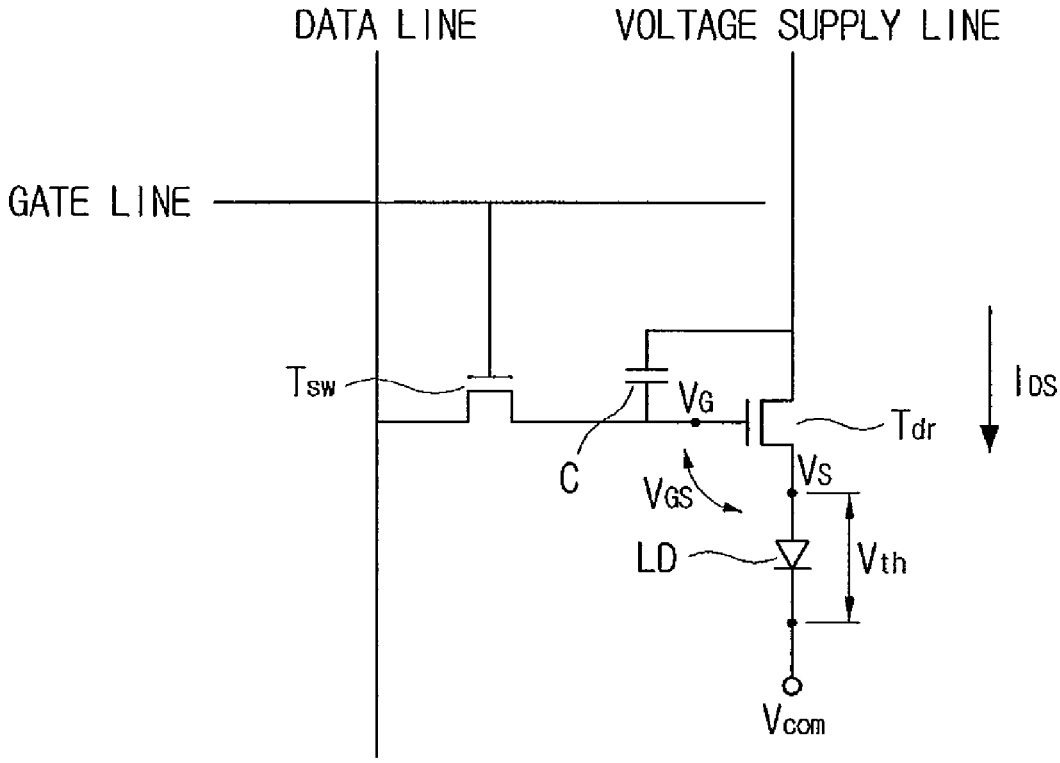
FIG. 1 is an equivalent circuit diagram of a pixel in a display device according to a first exemplary embodiment of the present invention.

FIG. 1 is an equivalent circuit diagram of a pixel in a display device according to a first exemplary embodiment of the present invention.

A plurality of signal lines is provided in a single pixel. The signal lines include a gate line which transmits a scanning signal, a data line which transmits a data signal, and a voltage supply line which transmits a driving voltage. The data line and the voltage supply line extend substantially parallel to each other. The gate line extends perpendicularly to the data line and the voltage supply line.

Each of pixels includes an organic light emitting layer LD, a switching thin film transistor Tsw, a driving thin film transistor Tdr and a capacitor C.

The switching thin film transistor Tsw includes a control terminal as a gate electrode, an input terminal as a drain electrode and an output terminal as a source electrode. The control terminal is connected with the gate line. The input terminal is connected with the data line. The output terminal is connected with a gate electrode which serves as a control terminal of the driving thin film transistor Tdr. The switching thin film transistor Tsw transmits a data voltage from the data line to the driving thin film transistor Tdr according to the scanning signal supplied through the gate line.

The driving thin film transistor Tdr includes a control terminal, an input terminal and an output terminal. The control terminal is connected with the switching thin film transistor Tsw. The input terminal is connected with the voltage supply line. The output terminal is connected with the organic light emitting layer LD.

The organic light emitting layer LD includes an anode which is connected with the output terminal of the driving thin film transistor Tdr and a cathode which is connected with a common voltage Vcom. The organic light emitting layer LD emits lights at different intensities depending on an output current $I_{DS}$ of the driving thin film transistor Tdr, thereby displaying an image. The output current $I_{DS}$ of the driving thin film transistor Tdr varies depending on a gate-source voltage $V_{GS}$ applied between the control terminal and the output terminal. Since the organic light emitting layer LD has an inherent threshold voltage Vth, the gate-source voltage $V_{GS}$ is controlled in consideration of the common voltage Vcom and the threshold voltage Vth. The organic light emitting layer LD expresses gradations from lower levels to higher levels, i.e., from black to white colors, only if the gate-source voltage $V_{GS}$ is set in a proper range. Hereinafter, the present invention defines the gate-source voltage $V_{GS}$ expressing the lowest gradation, black, as a black voltage, and the gate-source voltage $V_{GS}$ expressing the highest gradation, white, as a white voltage.

The capacitor C is connected between the control terminal and the input terminal of the driving thin film transistor Tdr. The capacitor C charges and maintains the data voltage inputted to the control terminal of the driving thin film transistor Tdr.

Figure 2:
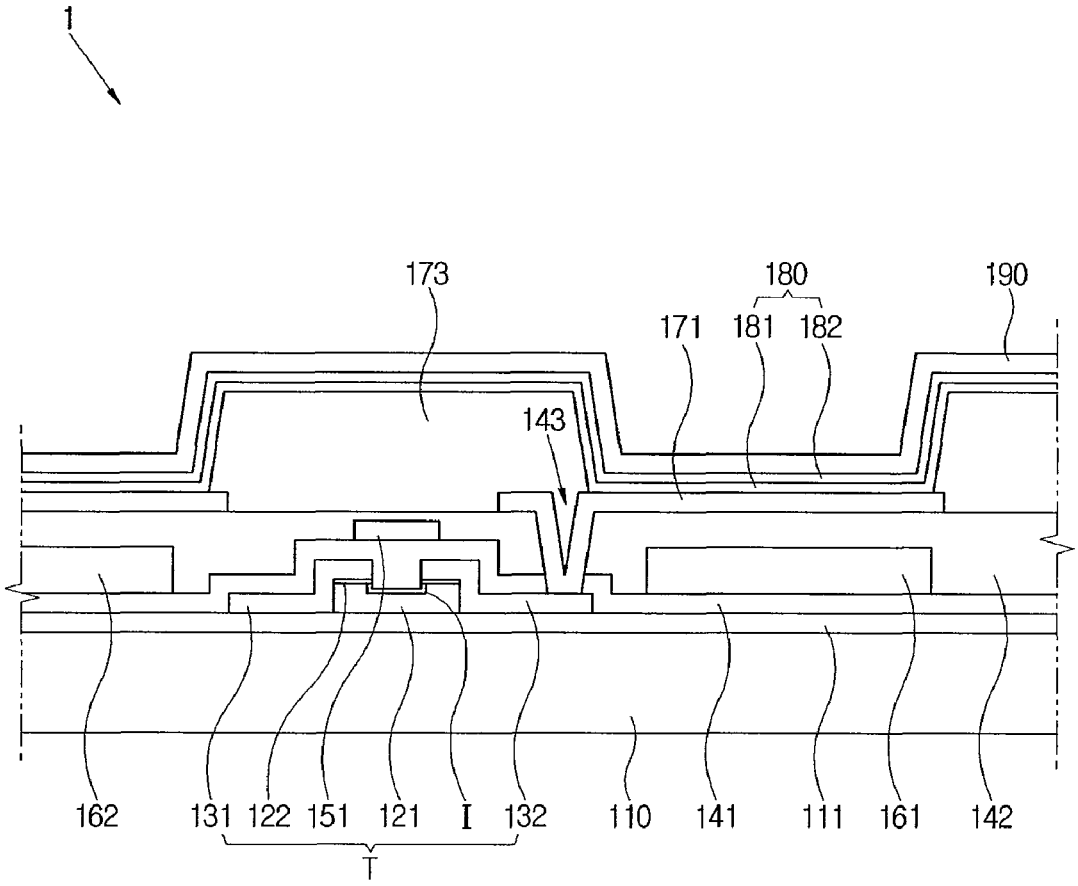
FIG. 2 is a sectional view of the display device according to the first exemplary embodiment of the present invention.

FIG. 2 is a sectional view of the display device according to the first exemplary embodiment of the present invention. Hereinafter, a display panel 1 which is included in the display device according to the first exemplary embodiment of the present invention will be described with reference to FIG. 2. FIG. 2 illustrates the driving thin film transistor Tdr and does not show the switching thin film transistor Tsw.

A buffer layer 111 is formed on an insulating substrate 110 including an insulating material such as glass, quartz, ceramic or plastic. The buffer layer 111 may include silicon oxide (SiOx) and prevents impurities of the insulating substrate 110 from being introduced to a semiconductor layer 121 while the semiconductor layer 121 crystallizes.

The semiconductor layer 121 includes poly silicon and is formed on the buffer layer 111. An ohmic contact layer 122 is formed on the semiconductor layer 121 and divided into two parts by the semiconductor layer 121. The semiconductor layer 121 disposed next to the ohmic contact layers 122 forms a channel region. A surface I is disposed on the semiconductor layer 121 of the channel region and includes fluorine. The semiconductor layer 121 of the channel region is thinner than that disposed under the ohmic contact layer 122. The ohmic contact layer 122 includes n+ poly silicon highly doped with an n-type dopant.

An amorphous silicon semiconductor layer and an amorphous silicon ohmic contact layer are patterned, heated and crystallized to form the semiconductor layer 121 and the ohmic contact layer 122. The amorphous silicon of the amorphous silicon semiconductor layer and the amorphous silicon ohmic contact layer is changed into poly silicon through crystallization. Suitable crystallization methods may include a solid phase crystallization, a laser crystallization and a rapid thermal annealing.

Solid phase crystallization (SPC) is a traditional and direct crystallization method, in which amorphous silicon is heated at a temperature below 600° C. for a long time to be changed into poly silicon of large crystal grains. The deposited material can be an amorphous material or poly silicon. Silicon ion or germanium ion may be deposited and the amorphous layer is thermally treated at a temperature below 600° C. for a long time to have poly silicon of large crystal grains.

Laser crystallization includes an excimer laser annealing and a sequential lateral solidification which uses laser to make poly silicon. In the rapid thermal annealing, amorphous silicon is deposited at a low temperature and its surface is rapidly heated to be crystallized.

The ohmic contact layer 122 of the channel region is etched to be divided into two parts (one on the left and one on the right, in FIG. 2). A part of the semiconductor layer 121 is also etched while the part of the semiconductor layer 121 disposed between the two parts of ohmic contact layers 122 is exposed. Thus, the semiconductor layer 121 of the channel region becomes thinner than that disposed under the ohmic contact layer 122. The ohmic contact layer 122 is etched by plasma, which damages the surface of the semiconductor layer 121 of the channel region. That is, a silicon-silicon bonding and a silicon-hydrogen bonding are destroyed, thereby generating an unstable silicon atom having a nonbonding site and making the semiconductor layer 121 amorphous. The unstable silicon atom may be combined with impurities by various contamination factors, or remains in an unstable state, in which case it lowers performance, stability and reliability of the thin film transistor.

To remove such an unstable silicon atom, the display device according to the present invention acid treats the exposed semiconductor layer 121. In acid-treating the display device, the exposed semiconductor layer 121 is dipped into hydrofluoric acid. The concentration of the hydrofluoric acid may be 0.001 volume % to 10 volume %, and the dipping process may take tens of seconds or minutes. If the concentration of the hydrofluoric acid is lower than 0.0001 volume %, it takes longer to process the semiconductor layer 121. Conversely, if the concentration of the hydrofluoric acid is higher than 10 volume %, the insulating substrate 110 may be damaged. The exposed semiconductor layer 121 may be acid treated at atmospheric or higher temperature and pressure to improve the acid treatment efficiencies. The surface of the exposed semiconductor layer 121 is polished by the acid treatment, and the unstable and amorphous silicon atom of the surface is etched and removed.

A source electrode 132 and a drain electrode 131 are respectively formed on the ohmic contact layers 122 that are divided into two parts. The source electrode 132 and the drain electrode 131 are typically simultaneously formed. The source electrode 131 and the drain electrode 132 may include a single metal layer or multiple layers.

A first insulating layer 141 is formed on the drain electrode 131, the source electrode 132 and the semiconductor layer 121. The first insulating layer 141 may include silicon nitride (SiNx).

A gate electrode 151 is formed on the first insulating layer 141 above the channel region. The gate electrode 151 may include a single metal layer or multiple layers.

Color filter layers 161 and 162 having different colors are formed on the first insulating layer 141 which is not formed with the driving thin film transistor Tdr and defines a pixel. The color filter layers 161 and 162 corresponding to the respective pixels have different colors such as red, green and blue colors which are repeated sequentially.

A second insulating layer 142 is formed on the gate electrode 151, the color filter layers 161 and 162, and the first insulating layer 141. The second insulating layer 142 serves as a planarization layer and may include an organic material. The organic material may employ one of benzocyclobutene (BCB) series, olefin series, acrylic resin series, polyimide series, fluoroplastic, etc.

A pixel electrode 171 as a transparent electrode is formed on the second insulating layer 142. The pixel electrode 171 includes a transparent conductive material such as indium tin oxide (ITO), indium zinc oxide (IZO), etc. A contact hole 143 is formed through the first and second insulating layers 141 and 142 extending to the source electrode 132. The pixel electrode 171 is electrically connected with the source electrode 132 through the contact hole 143. The pixel electrode 171 acts as an anode and supplies a hole to an organic light emitting layer 182.

A wall 173 is formed between the neighboring pixel electrodes 171. The wall 173 divides the pixel electrodes 171 and defines a pixel region. The wall 173 includes a photosensitive material such as acrylic resin, or polyimide resin which has heat resistance and solvent resistance, or an inorganic material such as $SiO_2$ and $TiO_2$. The wall 173 may have a double layered structure with an organic layer and an inorganic layer.

An organic layer 180 is formed on the pixel electrodes 171 that are not covered by the wall 173. The organic layer 180 includes a hole injecting layer 181 and the organic light emitting layer 182. The hole injecting layer 181 may employ an amine derivative which is highly fluorescent, e.g., a triphenyl diamine derivative, a styryl amine derivative, and an amine derivative having an aromatic condensed ring.

The organic layer 180 may further include a hole transport layer (not shown) between the hole injecting layer 181 and the organic light emitting layer 182, and an electron transport layer and/or an electron injecting layer (not shown) on the organic light emitting layer 182.

The organic light emitting layer 182 includes a low molecular material and emits white light. The organic light emitting layer 182 is deposited by an open mask. Light emitted from the organic light emitting layer 182 is colored red, green and blue by traveling through the color filter layers 161 and 162.

A common electrode 190 is disposed on the wall 173 and the organic light emitting layer 182. The common electrode 190 acts as a cathode and supplies electrons to the organic light emitting layer 182. The common electrode 190 may comprise a reflective metal layer. The reflective metal layer may include an opaque metal such as aluminum or silver.

A hole transmitted from the pixel electrodes 171 and an electron transmitted from the common electrode 190 are combined to form an exciton on the organic light emitting layer 182, thereby emitting light during a deactivation process of the exciton.

If the common electrode 190 includes an opaque material such as aluminum or silver, light is emitted from the organic layer 180 to the insulating substrate 110. An OLED with this configuration is called a bottom emission type OLED.

The display panel 1 may further include a passivation layer (not shown) to protect the common electrode 190, and an encapsulating member (not shown) to prevent moisture and air from being introduced to the organic light emitting layer 182. The encapsulating member may include a sealing resin and a sealing can.

Figure 3:
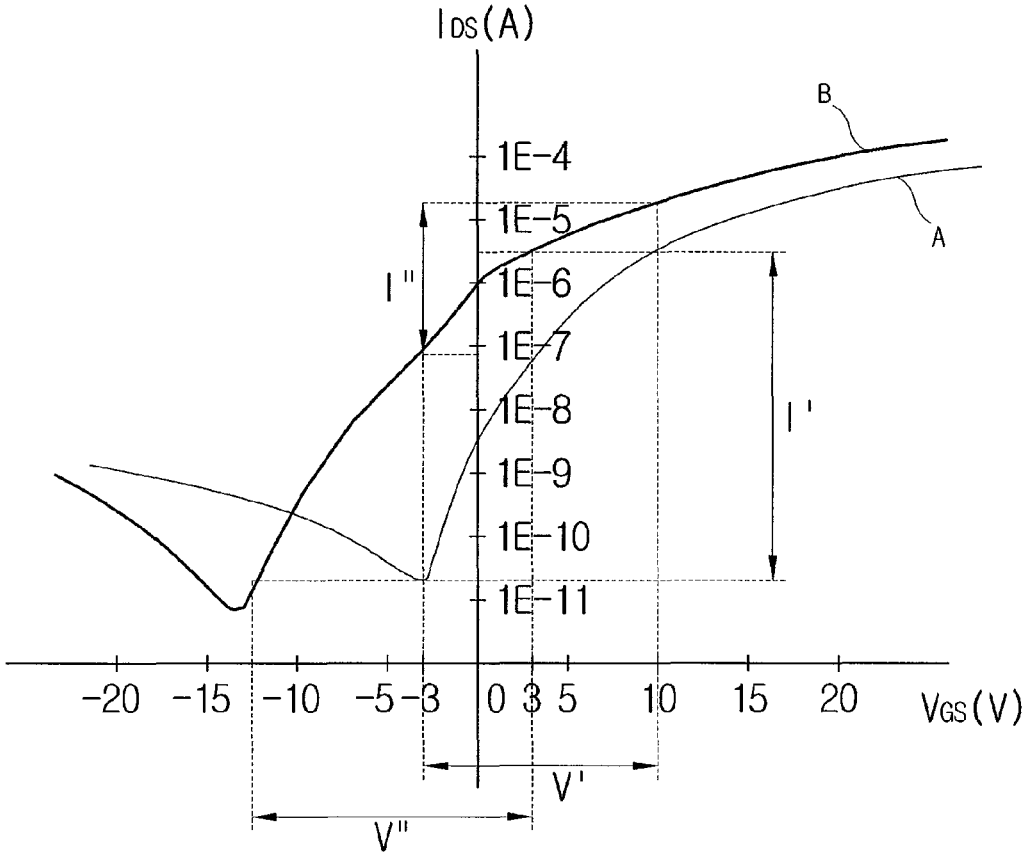
FIG. 3 illustrates current and voltages that are supplied to an organic light emitting layer of the display device according to the first exemplary embodiment of the present invention.

FIG. 3 illustrates current and voltages supplied to the organic light emitting layer 182 of the display device according to the first exemplary embodiment of the present invention. An axis x in a graph refers to a gate-source voltage $V_{GS}$ of the driving thin film transistor Tdr while an axis y is an output current $I_{DS}$ of the driving thin film transistor Tdr with respect to the gate-source voltage $V_{GS}$. A first curved line (A) demonstrates properties of a typical driving thin film transistor Tdr while a second curved line (B) illustrates properties of the driving thin film transistor Tdr formed by adding hydrofluoric acid to the semiconductor layer 121 as in the first exemplary embodiment of the present invention.

To express a black low gradation to a white high gradation through the organic light emitting layer 182 according to the first exemplary embodiment of the present invention, the output current $I_{DS}$ of the driving thin film transistor Tdr ranges from 1E-11 and 1E-10(A) to 1E-06 and 1E-05 (A) (a first current range I'). A threshold voltage of the organic light emitting layer 182, i.e., a voltage drop by the organic light emitting layer 182 is approximately 2.5V to 3.5V, and thus the gate-source voltage $V_{GS}$ of the driving thin film transistor Tdr is set in consideration of the common voltage Vcom supplied to the common electrode 190 and the voltage drop of 2.5V to 3.5V by the organic light emitting layer 182. The switching thin film transistor Tsw receives a data voltage at a predetermined level. The data voltage supplied to the switching thin film transistor Tsw may be considered as a gate voltage $V_G$ supplied to the gate electrode of the driving thin film transistor Tdr. The lowest data voltage supplied to the switching thin film transistor Tsw to express black is defined as a first voltage. The highest data voltage supplied to the switching thin film transistor Tsw to express white is defined as a second voltage. The first and second voltages have a relationship with the common voltage Vcom, the black voltage and the white voltage as follows: if the voltage drop by the organic light emitting layer 182 includes a constant, the black and white voltages change depending on the first and second voltages and the common voltage.

First voltage−common voltage−voltage dropped by organic light emitting layer=black voltage±|black voltage−white voltage|*0.1 [Equation 1]

second voltage−common voltage−voltage dropped by organic light emitting layer=white voltage±|black voltage−white voltage|*0.1 [Equation 2]

Referring back to FIG. 3, if the driving thin film transistor Tdr does not include fluoric acid, the gate-source voltage $V_{GS}$ in the first current range I' ranges from approximately −3V to 10V (a first voltage range V'). The lowest voltage, −3V, is the black voltage and 10V becomes the white voltage. That is, in the driving thin film transistor Tdr that was not prepared using fluoric acid, the gate-source voltage $V_{GS}$ should be within the first voltage range V' to properly express gradations. If the common electrode 190 is connected with a ground terminal to have the common voltage of 0V while the voltage drop by the organic light emitting layer 182 is 3V, the first voltage is 0V and the second voltage is about 13V. Also, the driving voltage is a positive voltage that is about 10V larger than the common voltage.

For the semiconductor layer 121 that is prepared using fluoric acid, the properties of the driving thin film transistor Tdr change to shift a current-voltage curved line to the left as the second curved line (B). That is, if the driving thin film transistor Tdr is driven according to the first voltage range (V'), the current flowing in the driving thin film transistor Tdr ranges from about 1E-08 to 1E-04 (A) (a second current range I"). As shown therein, the lowest current value (1E-07 (A)) exceeds the lowest current value (1E-11 to 1E-10 (A)) in the first current range I', thereby failing to properly express black in the display device according to the first exemplary embodiment of the present invention. In this case, the gate-source voltage $V_{GS}$ of the driving thin film transistor Tdr should be adjusted to be within a second voltage range V" so that the output current $I_{DS}$ of the driving thin film transistor Tdr including fluoric acid is within the first current period I'. The black voltage of the second voltage period V" is about −15V to −10V and the white voltage ranges between about −3V and 3V.

Figure 4:
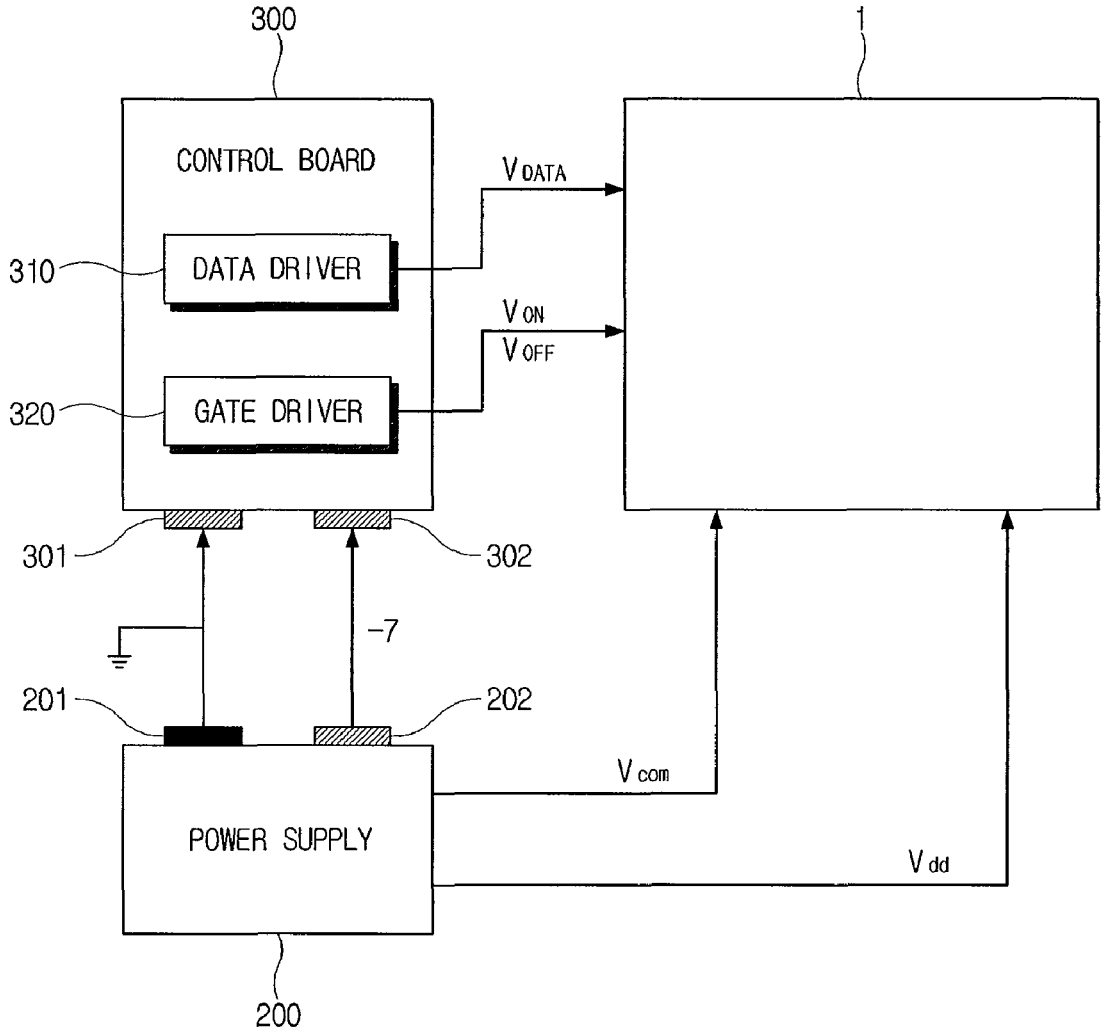
FIG. 4 is a control block diagram of the display device according to the first exemplary embodiment of the present invention.
Figure 5:
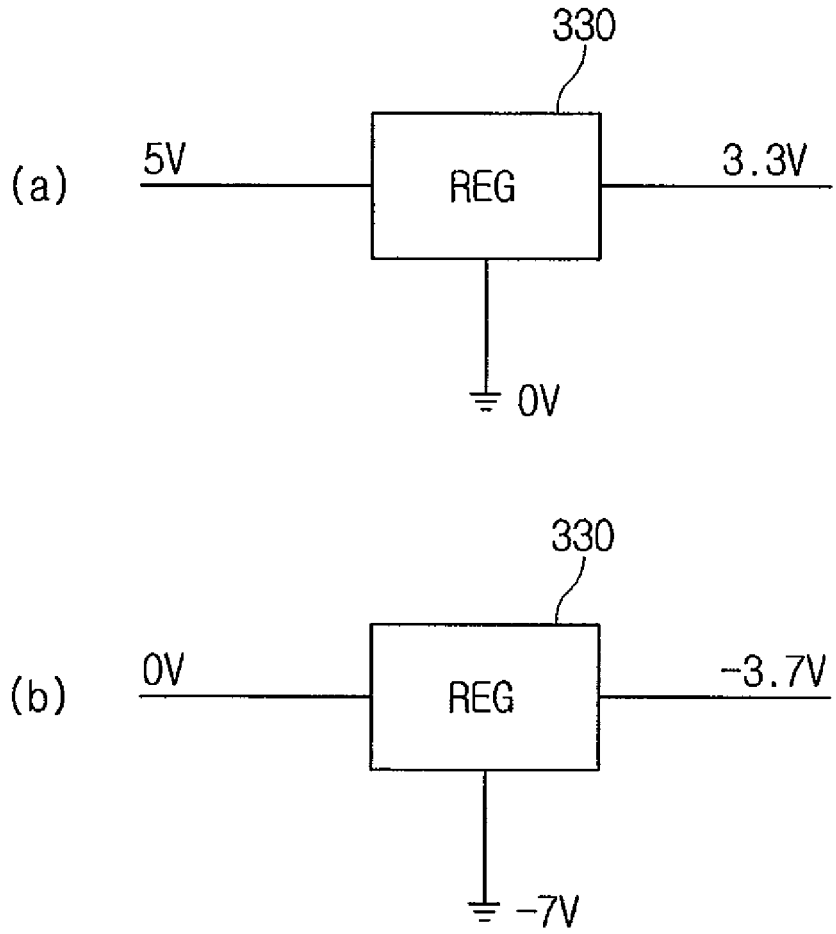
FIG. 5 illustrates a process of generating voltages in the display device according to the first exemplary embodiment of the present invention.
Figure 6:
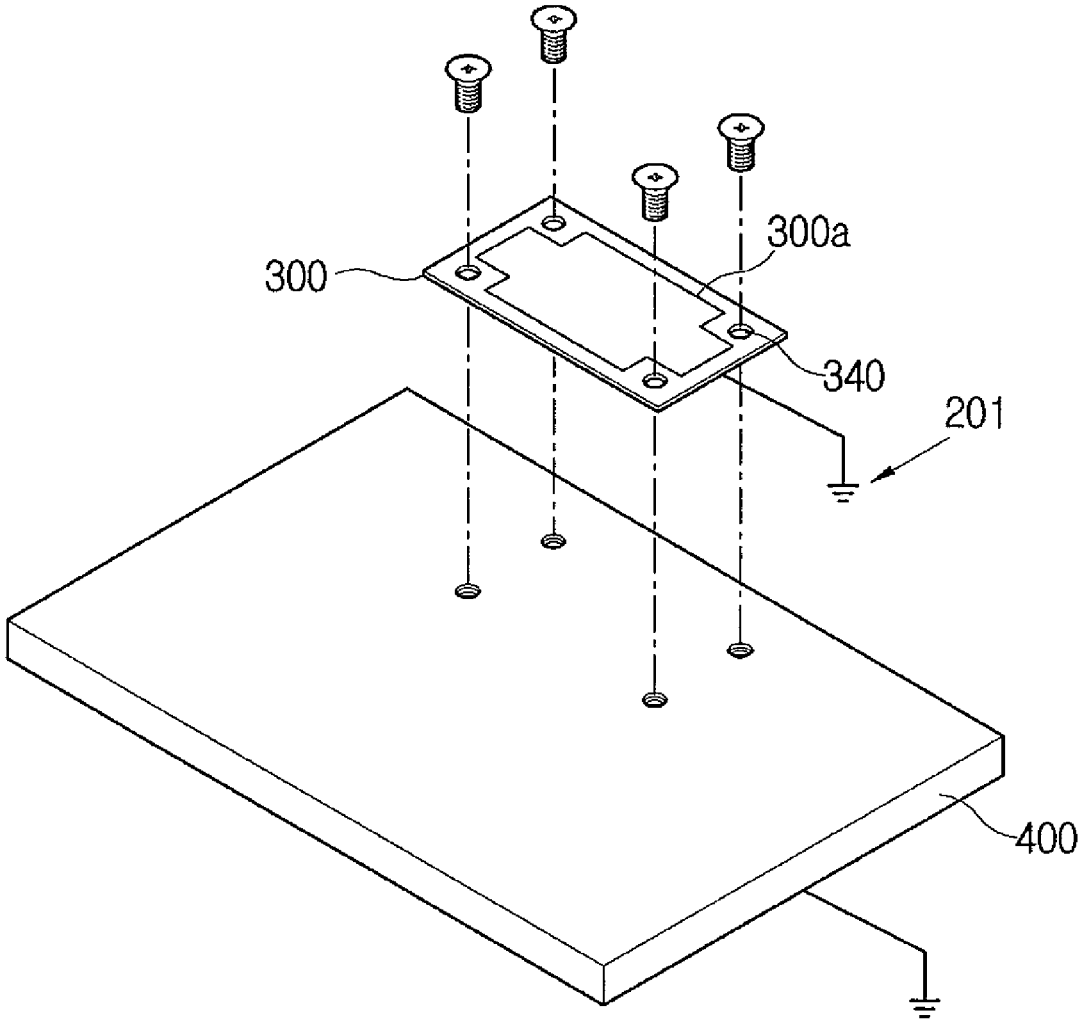
FIG. 6 illustrates a process of connecting a chassis and a control board of the display device according to the first exemplary embodiment of the present invention.

Hereinafter, a method of changing the first and second voltages corresponding to the properties of the driving thin film transistor Tdr, i.e., a method of supplying a negative voltage as the data voltage while maintaining the existing common voltage of 0V, will be described. FIG. 4 is a control block diagram of the display device according to the first exemplary embodiment of the present invention. FIG. 5 illustrates a process of generating voltages according to the first exemplary embodiment of the present invention. FIG. 6 illustrates a connection between a chassis and a control board of the display device according to the first exemplary embodiment of the present invention.

The display device according to the first exemplary embodiment of the present invention includes the display panel 1, a control board 300 which generates various signals to control the display panel 1, and a power supply 200 which supplies power to the display panel 1 and the control board 300.

The control board 300 includes a timing controller (not shown) and various signal generators including a data driver 310 and a gate driver 320. The foregoing elements form a predetermined circuit pattern 300*a* on the control board 300. The data driver 310 generates a final data voltage $V_{data}$ to be supplied to the data line based on an image signal outputted from the timing controller. The gate driver 320 generates a gate on voltage $V_{on}$ and a gate off voltage $V_{off}$ to be supplied to the gate line. The data driver 310 and the gate driver 320 respectively generate the data voltage $V_{data}$ and the gate on voltage $V_{on}$ and the gate off voltage $V_{off}$ by receiving power at a predetermined level from a regulator 330, which is included in the control board 300.

The power supply 200 supplies a reference power to the control board 300 and supplies a common voltage Vcom and a driving voltage Vdd at predetermined levels to the display panel 1. As described above, the common voltage Vcom according to the first exemplary embodiment of the present invention is at 0V or lower than 0V. The driving voltage Vdd is a positive voltage which is about 10V higher than the common voltage Vcom. Typically, the common voltage Vcom and the driving voltage Vdd generated by the power supply 200 are directly supplied to the display panel 1. Even if the common voltage Vcom and the driving voltage Vdd pass through the control board 300, they are not generated by the regulator 330 of the control board 300.

The control board 300 is connected with the power supply 200 through a reference power terminal 301 and a ground terminal 302. The reference power terminal 301 is connected with a ground terminal 201 of the power supply 200. The ground terminal 302 of the control board 300 is connected with a negative terminal 202 of the power supply 200. As shown therein, the power supply 200 and the ground terminals 201 and 302 of the control board 300 are not connected with each other. The voltage levels of the ground terminal 201 and 302 are different from each other. As shown in FIG. 5(*a*), the control board 300 is connected with the ground terminal that is at 0V and receives power at about 5V from the power supply 200. The regulator 330 regulates the power with 5V as a voltage that is 3.3V higher than that of the ground terminal, and outputs the voltage. The power with 3.3V outputted from the regulator 330 is inputted to the data driver 310 and the gate driver 320.

According to the first exemplary embodiment of the present invention, the reference power terminal 301 of the control board 300 is connected with the ground terminal 201 of the power supply 200. Thus, the control board 300 receives power with about 0V being the reference power. Since the ground terminal 302 is connected with the negative terminal 202 outputting a voltage of about −7V, the regulator 330 outputs a voltage of −3.7V, which is 3.3 V higher than −7V (see FIG. 5(*b*)). More specifically, according to the first exemplary embodiment of the present invention, as the voltage level of the ground terminal 302, which supplies the reference voltage level, drops from 0V to −7V, the level of all the voltages generated by the control board 300 is dropped by −7V. The negative voltage outputted to the negative terminal 202 may vary depending on the gate-source voltage $V_{GS}$ of the driving thin film transistor Tdr. Preferably, the voltage outputted to the negative terminal 202 ranges from −11.5 V to −6 V.

Since the reference voltage level is dropped by about 7V, the gate-on voltage Von is dropped from 10V to 3V and the gate-off voltage Voff is dropped from −7V to −14V. Also, if the data voltage ranges from 0V to 13V, it is dropped to −7V to 6V. That is, the low end of the voltage range becomes −7V and the high end of the voltage range is 6V with respect to the common voltage (0V).

If the common voltage Vcom is 0V and the gate-source voltage $V_{GS}$ of the driving thin film transistor Tdr ranges from about −13V to 3V, the data voltage outputted from the data driver 310 becomes a negative voltage. However, if the data driver 310 generating the negative voltage cannot be developed or cannot be provided due to production costs, the negative voltage may be generated by supplying the negative voltage to the ground terminal 302 of the control board 300, with respect to the common voltage 0V.

According to another exemplary embodiment of the present invention, the data driver may be provided to generate a data voltage ranging from −7V to 6V.

As shown in FIG. 6, the control board 300 is typically connected with a chassis 400 which supports and protects the display panel 1. The chassis 400 includes an insulating substrate and serves as the ground terminal. According to the first exemplary embodiment of the present invention, the ground voltage level of the chassis 400 is different from that of the control board 300, thereby possibly causing static electricity or electromagnetic interference. To prevent this problem, the circuit pattern 300*a* which is formed in the control board 300 is insulated from a connector 340 that is connected with the chassis 400. The connector 340 is connected with the ground terminal 201 of the power supply 200 through a screw, etc. That is, the connector 340 and the chassis 400 have the same ground level, thereby preventing electromagnetic interference. The connector 340 is electrically insulated from the circuit pattern 300*a*.

Figure 7:
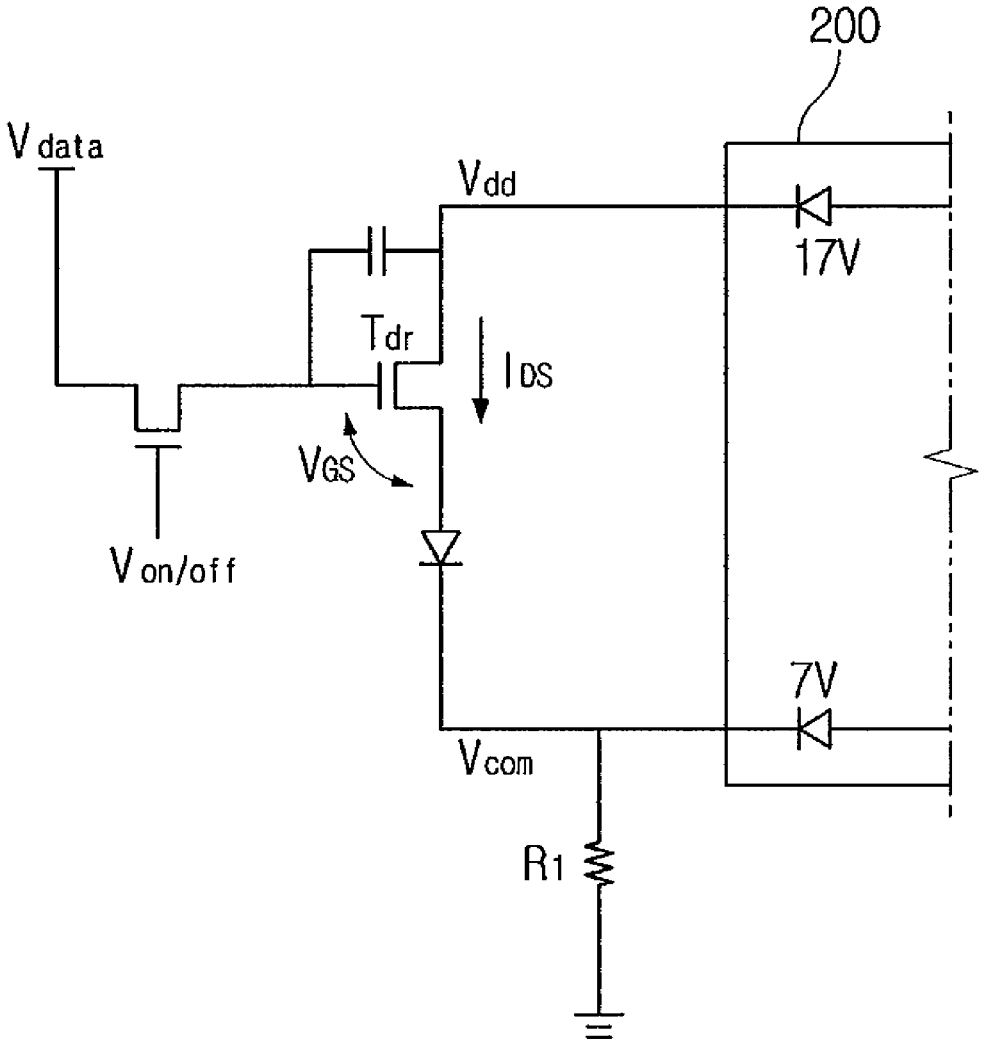
FIG. 7 illustrates a schematic circuit diagram of a display device according to a second exemplary embodiment of the present invention.

FIG. 7 is a schematic circuit diagram of a display device according to a second exemplary embodiment of the present invention. According to the second exemplary embodiment of the present invention, black and white voltages are generated by adjusting a common voltage within an existing range (0V to 13V) of a data voltage. This differs from the first exemplary embodiment of the present invention, where the data voltage is controlled.

As shown in FIG. 7, a power supply 200 outputs a driving voltage Vdd of 17V and a common voltage Vcom of 7V. That is, the power supply 200 outputs positive voltages as the common voltage Vcom and the driving voltage Vdd. The display device further includes a resistor R1 which is connected between a common electrode 190 and the power supply 200. The power supply 200 includes a diode which is connected with a voltage supply line and the common electrode 190 to output the positive voltage. Because both the common voltage Vcom and the driving voltage Vdd are positive voltages, a current does not flow to a driving thin film transistor Tdr unless the resistor R1 is not provided in the display device. Thus, the display device allows current to flow from the voltage supply line to the common electrode 190 through the resistor R1 connected between the common electrode 190 and the power supply 200, thereby discharging the current flowing to the common electrode 190.

Figure 8:
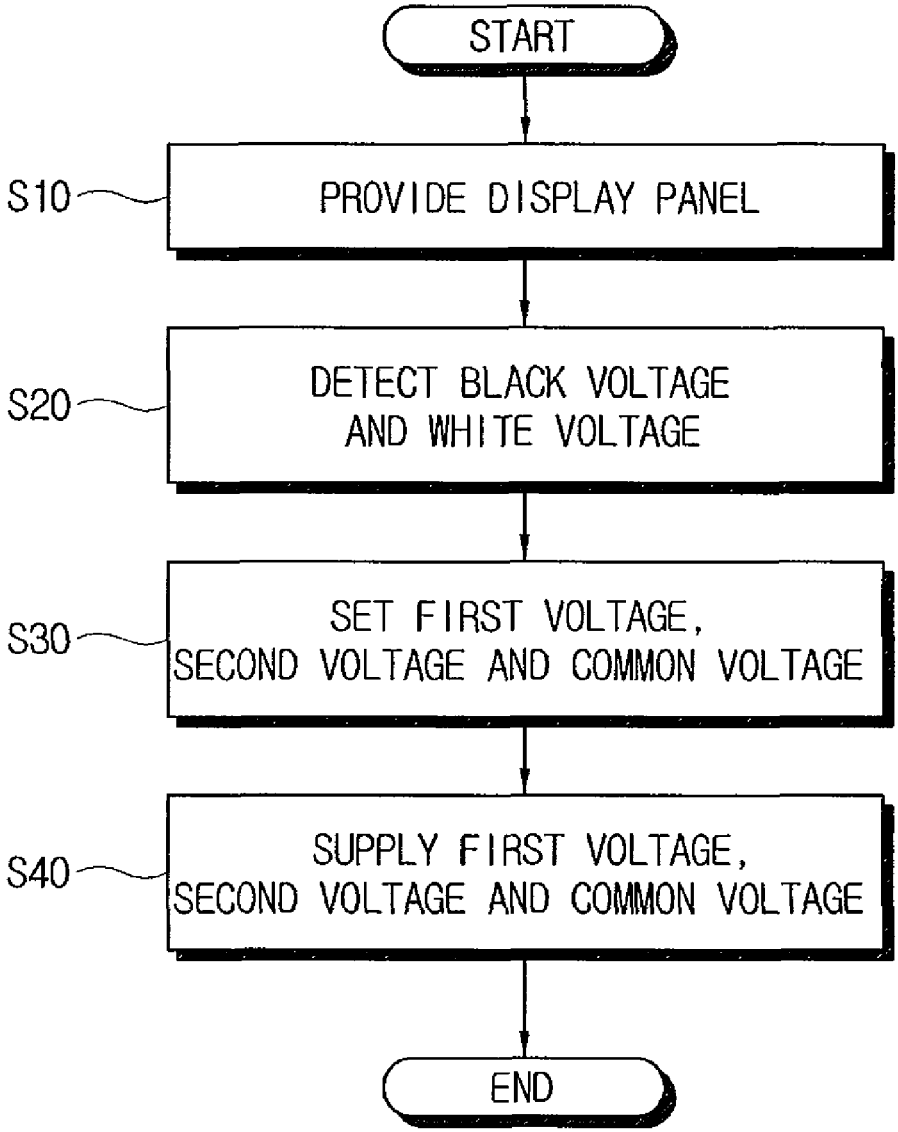
FIG. 8 is a control flowchart of the display device according to the present invention.

FIG. 8 is a control flowchart of the display device according to the present invention. A method of driving the display device according to the present invention will now be described with reference to FIG. 8.

First, the display panel 1 is provided (S10). The display device 1 includes the switching thin film transistor Tsw and the driving thin film transistor Tdr having the semiconductor layer 121 including silicon and fluorine, the pixel electrodes 171 electrically connected with the driving thin film transistor Tdr, the organic light emitting layer 182 formed on the pixel electrodes 171 and the common electrode 190 supplying the common voltage to the organic light emitting layer 182.

Then, the ranges of the black voltage and the white voltage with respect to the gate-source voltage $V_{GS}$ of the driving thin film transistor Tdr is detected from the drain-source current $I_{DS}$ (S20). According to an embodiment of the present invention, the black voltage is around −15V to 10V and the white voltage is around 3V to 5V.

Then, first voltage and second voltage ranges that satisfy the black and white voltages and the common voltage are set (S30).

The relation between the data voltage of the first to second voltage ranges and the common voltage is shown by the following equations. According to the embodiment of the present invention, the voltage drop by the organic light emitting layer 182 is about 2.5V to 3.5V.

First voltage−common voltage−voltage dropped by organic light emitting layer=black voltage±|black voltage−white voltage|*0.1 [Equation 1]

Second voltage−common voltage−voltage dropped by organic light emitting layer=white voltage±|black voltage−white voltage|*0.1 [Equation 2]

If the common voltage is set below 0V by the foregoing equations, the first voltage of the data voltage becomes the negative voltage. If the first voltage is a positive voltage, the common voltage becomes the positive voltage.

Then, the set first voltage, second voltage and common voltage Vcom are supplied to the display panel 1 (S40).

In the manner described above, the present invention provides a display device which clearly expresses gradations, and a driving method of the same.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A display device, comprising:

an insulating substrate;

a switching thin film transistor and a driving thin film transistor formed on the insulating substrate, the driving thin film transistor including a semiconductor layer;

a first electrode electrically connected with the driving thin film transistor;

a light emitting layer formed on the first electrode;

a second electrode which supplies a common voltage at a predetermined level to the light emitting layer; and a data driver which supplies a data voltage to the switching thin film transistor, the data voltage ranging from a first voltage to a second voltage and wherein the first voltage, the second voltage and the common voltage satisfy the following equations:

First voltage−common voltage−voltage dropped by light emitting layer=black voltage±|black voltage−white voltage|*0.1 [Equation 1]

Second voltage−common voltage−voltage dropped by light emitting layer=white voltage±|black voltage−white voltage|*0.1, [Equation 2]

wherein the black voltage refers to a gate-source voltage ($V_{GS}$) that expresses the lowest gradation and the white voltage refers to a gate-source voltage $V_{GS}$ that expresses the highest gradation.

2. The display device according to claim 1, wherein the semiconductor layer comprises silicon and fluorine.

3. The display device according to claim 2, wherein the black voltage ranges from −15V to −10V.

4. The display device according to claim 3, wherein the white voltage ranges from 3V to 5V.

5. The display device according to claim 4, wherein the voltage drop by the light emitting layer is 2.5V to 3V.

6. The display device according to claim 5, wherein the common voltage is 0V or lower.

7. The display device according to claim 6, further comprising:

a control board having the data driver thereon and connected with the insulating substrate, and a power supply having a negative terminal to output a negative voltage and supplying power to the control board, wherein a ground terminal of the power supply is connected with a reference power terminal of the control board and the negative terminal is connected with a ground terminal of the control board.

8. The display device according to claim 7, wherein the negative terminal outputs a negative voltage ranging from −11.5V to −6V.

9. The display device according to claim 7, further comprising a chassis which accommodates the insulating substrate, wherein the control board further comprises a connector to be connected with the chassis, and the connector is connected with the ground terminal of the power supply.

10. The display device according to claim 9, wherein a predetermined circuit pattern is formed on the control board and the connector is insulated from the circuit pattern.

11. The display device according to claim 2, wherein the semiconductor layer comprises poly silicon.

12. The display device according to claim 5, further comprising:

a power supply which supplies the common voltage to the second electrode and a driving voltage to the driving thin film transistor, and a resistor which is connected between the second electrode and the power supply if the driving voltage and the common voltage are 0V or higher.

13. The display device according to claim 6, wherein the data driver generates a negative data voltage.

14. A method of driving a display device, comprising:

providing a display panel which includes a switching thin film transistor and a driving thin film transistor having a semiconductor layer comprising silicon and fluorine, a first electrode electrically connected with the driving thin film transistor, a light emitting layer formed on the first electrode and a second electrode supplying a common voltage at a predetermined level to the light emitting layer, detecting black and white voltage ranges with respect to a gate-source voltage $V_{GS}$ of the driving thin film transistor from a drain-source current $I_{DS}$;

setting a data voltage range between a first voltage range and a second voltage range, and setting the common voltage supplied to the switching thin film transistor to satisfy the following equations;

First voltage−common voltage−voltage dropped by organic light emitting layer=black voltage±|black voltage−white voltage|*0.1 [Equation 1]

Second voltage−common voltage−voltage dropped by organic light emitting layer=white voltage±|black voltage−white voltage|*0.1 [Equation 2]

(wherein the black voltage refers to gate-source voltage $V_{GS}$ that expresses the lowest gradation, and the white voltage refers to gate-source voltage $V_{GS}$ that expresses the highest gradation); and supplying the set first voltage, second voltage and common voltage to the display panel.

15. The method according to claim 14, wherein detecting the black and white voltage ranges comprises detecting the black voltage range as between about −15V to about −10V and detecting the white voltage range as between about 3V to about 5V, and setting the common voltage at 0V or lower if the voltage drop by the light emitting layer is 2.5V to 3V.

16. The method according to claim 15, wherein the display device further comprises a control board which is connected with the display panel and has a predetermined circuit pattern, and a power supply which has a negative terminal to output a negative voltage and supplies power to the control board, and the supplying of the voltage comprises connecting a ground terminal of the power supply and a reference power terminal of the control board, and connecting the negative terminal and a ground terminal of the control board.

17. The method according to claim 16, wherein the negative terminal outputs a voltage ranging from −11.5V to −6V.

18. The method according to claim 16, wherein the display device further comprises a chassis to accommodate the display panel, and the control board further comprises a connector connected with the chassis and insulated from the circuit pattern, the method further comprising:

connecting the connector to the ground terminal of the power supply.

* * * * *